United States Patent [19]

Blake

[11] Patent Number: 4,836,003

[45] Date of Patent: Jun. 6, 1989

[54] SYSTEM FOR PROVIDING A LIQUID TO A BLIND RIVET SETTING MECHANISM

[75] Inventor: Jeffrey T. Blake, Milford, Conn.

[73] Assignee: Emhart Industries, Inc., Farmington, Conn.

[21] Appl. No.: 244,751

[22] Filed: Sep. 14, 1988

[51] Int. Cl.[4] ..... B21C 9/00

[52] U.S. Cl. ..... 72/44; 72/43; 72/391

[58] Field of Search ..... 72/41, 43, 44, 45, 391, 72/453.17; 29/243.53

[56] References Cited

U.S. PATENT DOCUMENTS 4,184,357 1/1980 Stubbings ..... 72/391
4,655,065 4/1987 Sansome et al. ..... 72/45

FOREIGN PATENT DOCUMENTS 2154788 5/1973 Fed. Rep. of Germany ..... 72/391

*Primary Examiner*—David Jones
*Attorney, Agent, or Firm*—Thomas S. Szatkowski

[57] ABSTRACT

An automatic system for providing a liquid to a rivet setting mechanism is described. The liquid lubricates, cleans, and cools the rivet setting mechanism. The system includes a reservoir for the liquid, a metering device, and controls.

8 Claims, 3 Drawing Sheets

SYSTEM FOR PROVIDING A LIQUID TO A BLIND RIVET SETTING MECHANISM

BACKGROUND OF THE INVENTION

1. FIELD OF THE INVENTION

The invention relates to blind rivet setting tools and, in particular, an automatic system for providing a liquid to the rivet setting mechanism of the tool. The liquid serves to lubricate, clean, and cool the rivet setting mechanism.

2. DESCRIPTION OF THE PRIOR ART

The carbon steel wire used for rivet mandrels is typically coated with phosphate to prevent rusting. Such phosphates, however, present problems in the mandrel heading operation by causing deposits and gumming up the heading dies and cutters. It is known that phosphate build-up problems are addressed in the heading operation by providing oil on the wire in a continuous dripping manner.

Finished carbon steel mandrels also are phosphate coated and present similar gumming problems with respect to the serrated jaws of typical rivet setting mechanisms. Such jaws may become plugged or fouled from phosphate build-up. It is also known that phosphate build-up problems on serrated holding jaws of an apparatus for testing the endurance of rivet setting tools were addressed by providing an uninterrupted flow of a lubricant oil to the holding jaws.

The rivet setting mechanism of a rivet setting tool encounters more contamination than the phosphate build-up described above in connection with holding jaws. As the rivet mandrel is broken within the housing of the rivet setting mechanism, small metallic particle debris is formed which adds to contamination. Such metallic particles may deposit on various parts of the mechanism and cause high rates of wear.

Blind rivet setting tools are typically lubricated and cleaned by inserting the nosepiece and housing of the tool, in which the rivet setting mechanism and jaws are located, into a container of lubricant and repeatedly actuating the mechanism. The excess is allowed to drip back into the container and residues are wiped off. Drawbacks with this approach include the fact that it is extremely time consuming and messy. Also, each tool operator will perform the task differently and at different intervals. Thus, with this approach, there is no way to insure that the mechanism and jaws are properly lubricated, either in a timely manner or with an appropriate quantity of lubricant. In addition, this approach has little utility in connection with automatic or robotic rivet installation systems, which would have to be taken out of service to lubricate in this manner.

SUMMARY OF THE INVENTION

The invention provides an automatic system for lubricating, cleaning, cooling, and flushing debris and contaminants from the rivet setting mechanism of a rivet setting tool, especially the jaws of such mechanism. The system includes a reservoir of a suitable liquid material, a metering device which measures a predetermined amount of the liquid, controls for controlling the intervals at which the predetermined amount of liquid is supplied to the rivet setting mechanism and a vacuum for dispersing the liquid throughout the mechanism and removing the used liquid and contaminants from the housing in which the mechanism is located.

DESCRIPTION OF THE PREFERRED EMBODIMENT

The automatic lubrication, cleaning, cooling, and flushing system of the present invention may be utilized with known pneumatic and hydraulic rivet setting tools of the type having a rivet setting mechanism containing jaws. Suitable rivet setting tools are disclosed in U.S. Pat. Nos. 3,254,522 and 4,517,820. Generally, these tools feature a pair of jaws adapted to grip the mandrel of a blind rivet, a jaw guide to force the jaws against the mandrel during the setting operation, and a draw bar connected to the jaw guide and the power source to pull the jaws and the mandrel so that the mandrel first upsets the rivet body and then is broken off. Two serious problems with these types of devices are that of high jaw wear and the generation of particulate contamination. The present system provides a major improvement in reducing such problems. The automatic system of the present invention may also be advantageously utilized in connection with rivet setting devices equipped with fastener presentation devices such as disclosed in U.S. Pat. No. 4,747,294, and automatic rivet installation devices such as disclosed in U.S. Pat. No. 4,754,643.

Figure 1:
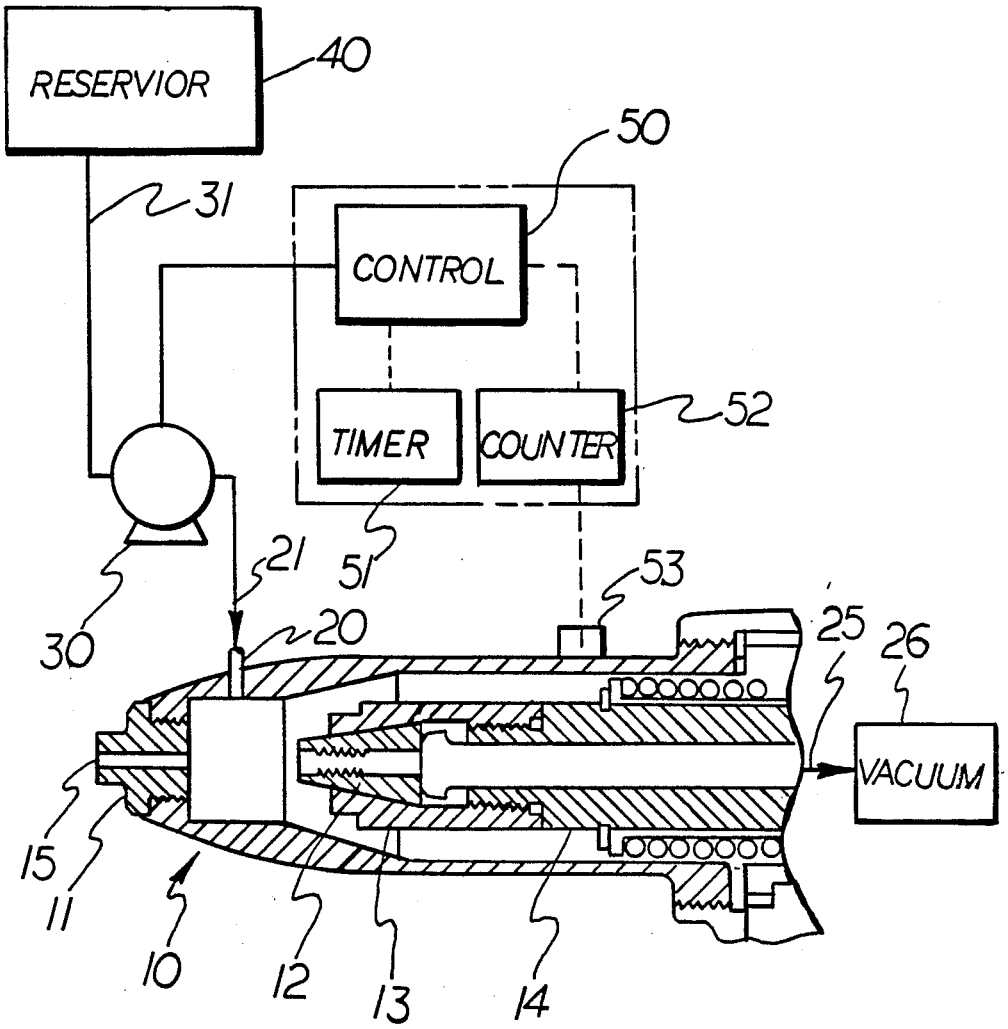
FIG. 1 depicts one embodiment of a system according to the present invention.

Referring to FIG. 1, one embodiment of the system of the present invention is shown. A blind rivet setting mechanism is located within housing 10. Any rivet setting mechanism known to the art may be utilized in connection with the system of the present invention. Typically, such setting mechanism includes jaws 12 located within a jaw guide 13. A draw bar 14 is connected to the jaw guide and to the power source (not shown). Nosepiece 11, having an aperture 15, is attached to the housing. A rivet is set by inserting the mandrel of the rivet through the aperture 15 of the nosepiece. The nosepiece serves to align the mandrel with jaws 12. When the power is applied, the jaw guide moves in the direction away from nosepiece 11, causing jaws 12 to bite into the mandrel and move it in the same direction. As the mandrel moves, the rivet body is deformed. When the deformation is complete, the mandrel breaks. The action of digging into the mandrel and the mandrel breaking is a prime cause of jaw wear and contamination.

Aperture 20 is provided in housing 10 to introduce a liquid into the housing to lubricate, clean, and cool the rivet setting mechanism and flush away contaminants. Aperture 20 is located at the section of the housing near to nosepiece 11 so that the liquid can be dispersed over the entire mechanism by the action of the vacuum. It may be desirable to have an atomizer at the point of introduction of the liquid so that liquid is introduced in an atomized form.

Liquid delivery line 21 connects aperture 20 to pump 30. Pump 30 is, in turn, connected via line 31 to reservoir 40, which holds a suitable supply of liquid. Pump 30 may be of any suitable pump, but preferably is a metering pump, capable of pumping at a constant rate so that precise predetermined quantities of lubricant can be provided.

A control function is provided to meter the predetermined amount of liquid as well as the intervals at which the liquid is introduced to the housing. The control function may include a controller, timer, and counter. Alternatively, the control function may be carried out in one unit, such as a programmable logic controller, computer, or microprocessor.

Pump 30 is activated and deactivated by control 50 for a time sufficient to pump the predetermined quantity. Control 50 may be an adjustable time delay relay or a monostable multivibrator. Other equivalent devices may also be employed. Control 50 may also have an ON/OFF switch so that the automatic system can be turned off when the rivet setting tool is not in use. The ON/OFF switch function could also have a motion sensor associated therewith so that the automatic system is turned off when the rivet setting tool is not in use. Time 51, or counter 52, are associated with control 50 to determine the intervals at which the predetermined quantity of liquid is introduced to housing 10. Liquid may be introduced at predetermined time intervals, for example, after from about 15 minutes to about 10 hours or after a predetermined amount of rivets have been set; for example, after from about 50 to about 1,000 rivets have been set. Once the predetermined time interval, or predetermined amount of rivets has been established, control 50 activates pump 30 for an amount of time sufficient to pump a predetermined amount of liquid into the housing 10.

Timer 51 may be an adjustable time delay relay, repeat cycle timer, clock or any other equivalent device. Time intervals, on the order of magnitude of from about 15 minutes to about 10 hours, are typically employed with about 4 hours being preferred. Counter 52 may be any event counter. Sensor 53 is associated with counter 52. Sensor 53 can be any sensor which provides a signal to the counter based upon spent mandrels, tool cycles via pneumatic or hydraulic monitoring, limit switch associated with the trigger of the tool, displacement of a hydraulic piston, delivery of rivet assemblies to the tool, or power ON/OFF of the tool. It will be appreciated that the functions described in connection with control 50, timer 51, counter 52, and sensor 53 could be carried out in one unit such as a programmable logic controller, a computer, or a microprocessor.

The predetermined quantity of liquid to be introduced to the housing may vary according to the following factors: type of liquid employed, types of rivets set, size of rivet set, size and type of rivet setting mechanism, and rate of usage of tool, i.e., speed at which rivets are set. Generally, this quantity will be determined according to the factors set forth above, and the control 50 will be adjusted so that it activates the pump to provide precisely that quantity. Typically, quantities from about 0.1 cc to about 10 cc to are employed.

Any suitable liquid may be used in the system of the present invention. Exemplary liquids include oleaginous materials, such as lubricants which may be liquid hydrocarbon oils in the form of mineral oils or synthetic oils, aqueous based materials, metal working fluids, solvents, or suspensions or dispersions of molybdenum disulphide or graphite in a suitable carrier. The liquids may contain other materials, such as anti-rust agents, supplementary or co-antioxidants or detergents. These other materials do not detract from the liquids employed in the system of the invention, but rather serve to impart their customary properties to the liquid. The types of liquid employed may vary according to the types of rivets set, sizes of rivets set, rate at which rivets are set, and the size and type of the setting mechanism. A preferred liquid is petroleum derived mineral oil.

Reservoir 40 may be any suitable container for the liquid. Its size is subject to the specific application. For an application in which the system is in place on a hand-held setting device, it may be desirable that a small reservoir holding approximately one day's, or shift's, worth of liquid be used. For other permanent installations, the reservoir may be much larger.

Vacuum line 25 is connected to housing 10 at the end opposite nosepiece 11. Vacuum is produced by vacuum transducer 26. The vacuum serves to disperse the liquid throughout the rivet setting mechanism. In addition, the vacuum removes used liquid and contaminants which are caught by the liquid. In setting devices equipped with a vacuum mandrel collection system, the vacuum from the mandrel collection system will adequately serve the vacuum function. In setting devices not so equipped, a separate vacuum system must be employed. In either situation, the vacuum is typically provided by a vacuum transducer connected to an air supply. Other equivalent air evacuation sources such as fans, vacuum pumps, and the like may also be employed.

Figure 2:
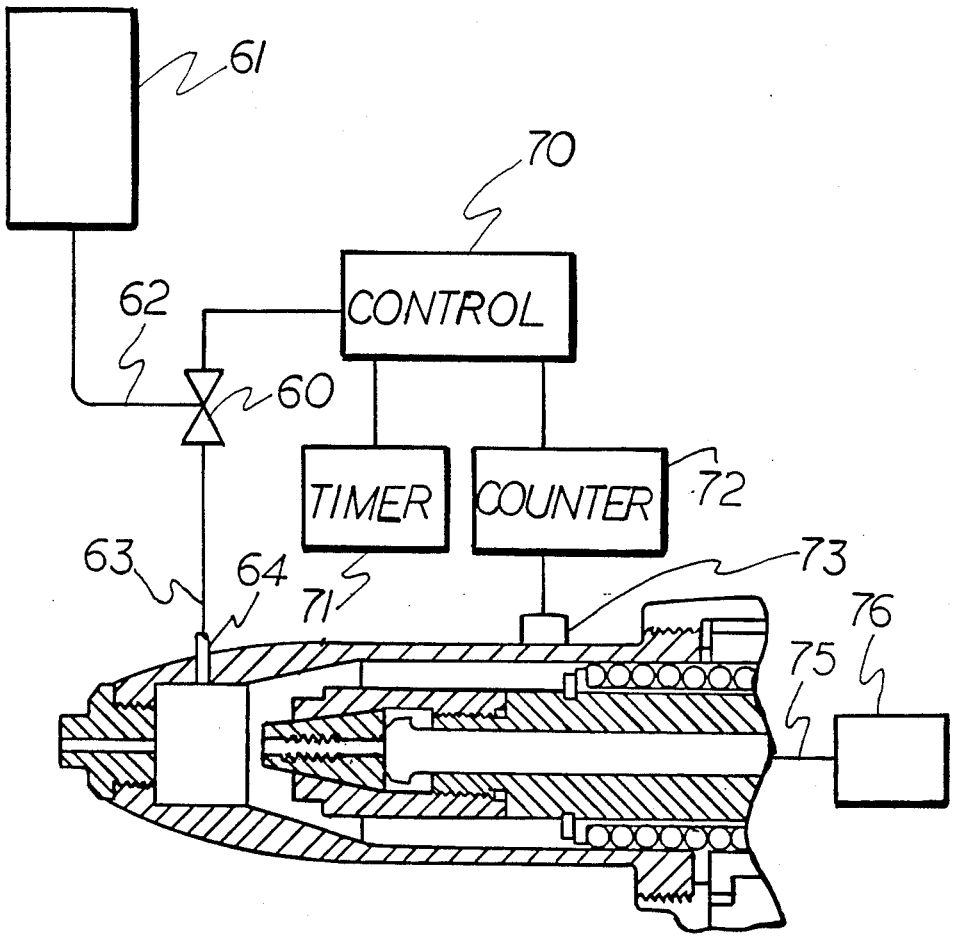
FIG. 2 depicts another embodiment of a system according to the present invention.

The vacuum may also provide the moving force to transport the liquid from the reservoir to the aperture. In such a system, a device such as pump 30 is replaced with a simple metering valve. The action of the vacuum serves to pull the liquid from the reservoir to the rivet setting mechanism. FIG. 2 depicts such a system. Referring to the FIG. 2, metering valve or orifice 60 connects reservoir 61 to aperture 64 via lines 62 and 63. Valve 60 is controlled via control 70, timer 71, counter 72, and sensor 73 as described previously. Vacuum line 75 is connected to the rear of the housing in which the rivet setting mechanism is located. The vacuum is generated by vacuum transducer 76, or any suitable means. In this embodiment, transport of the liquid from the reservoir to the aperture 74, as well as dispersion of the liquid within the rivet setting mechanism, is brought about by the vacuum.

Figure 3:
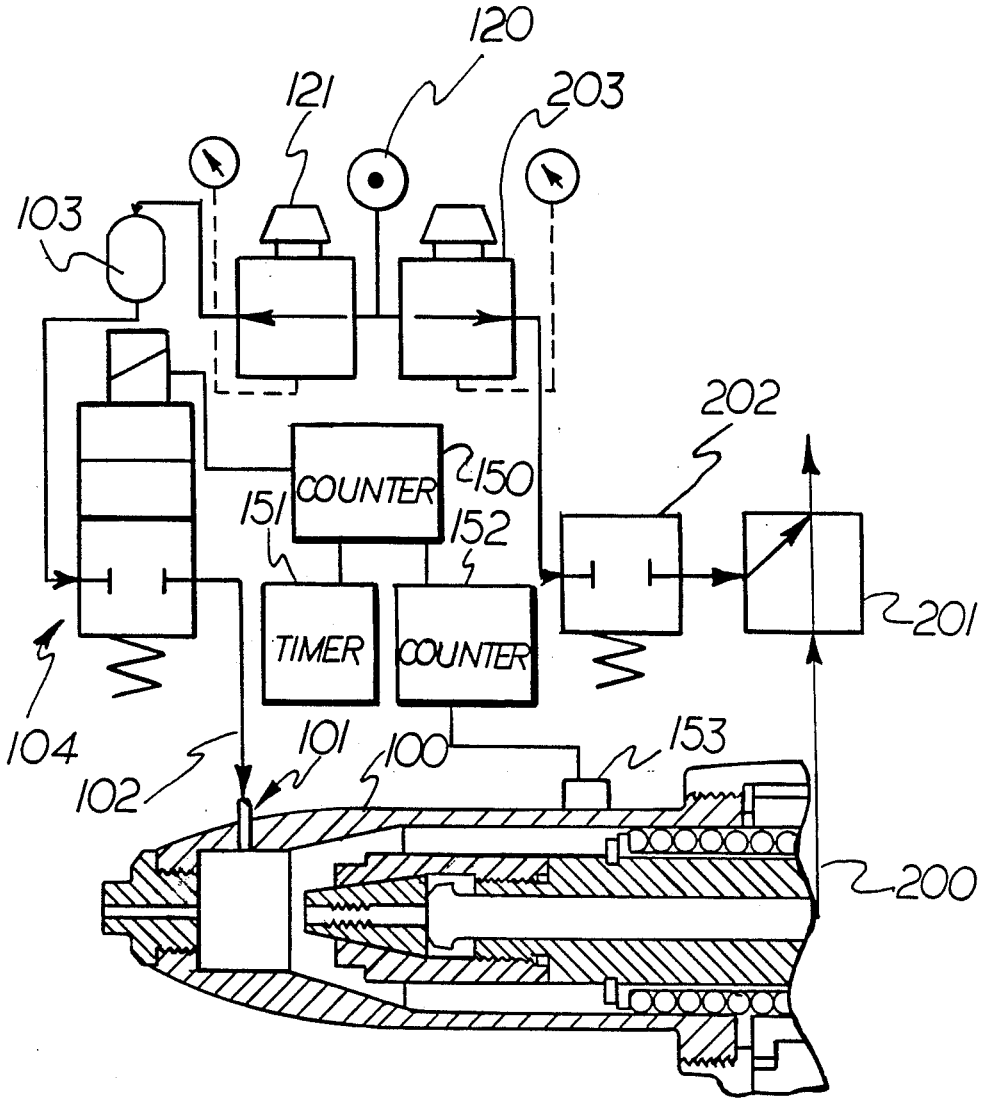
FIG. 3 depicts a third embodiment of a system according to the present invention

Referring to FIG. 3, another embodiment of the invention is depicted. Housing 100, which contains the rivet setting mechanism, contains aperture 101 for receiving liquid. Line 102 connects reservoir 103 to aperture 101 by way of solenoid operated metering valve 104. Reservoir 103 is a pressurized container holding liquid under pneumatic pressure. Constant pressure is supplied by air from air supply 120, which is regulated by regulator 121. Any pressure is usable, but pressures of 75 to 100 are typically employed. Metering valve 104 supplies a predetermined amount of liquid to the housing. In operation, the valve is opened for a predetermined amount of time, responsive to a signal from control 150, allowing liquid under pressure to flow through. The amount of time that the valve is held open is determined by control 150. The intervals at which the predetermined amount of liquid is supplied to the housing are determined by timer 151 or counter 152. Lubricant can thus be introduced after certain time intervals, or after a certain number of rivets have been set. Counter 152 includes a sensor 153 as previously described. Vacuum line 200 provides vacuum via a vacuum transducer 201 connected via shut-off valve 202 and pneumatic regulator 203 to air supply 120.

I claim:

1. A system for providing a liquid to a rivet setting mechanism of a blind rivet setting tool for lubricating, cleaning, or cooling said mechanism which system comprises:

a reservoir of a liquid;

metering means for providing a predetermined amount of liquid to said rivet setting mechanism;

control means for controlling the intervals at which said predetermined amount of liquid is provided to said rivet setting mechanism; and vacuum means for dispersing the liquid throughout the rivet setting mechanism, and removing used liquid and contaminants from said rivet setting mechanism.

2. The system of claim 1 wherein said metering means includes a pump.

3. The system of claim 1 wherein said metering means includes a valve.

4. The system of claim 1 wherein said control means comprises a timer and said interval is a predetermined time.

5. The system of claim 1 wherein said control means comprises an event counter, and said interval is a predetermined number of rivets set.

6. The system of claim 5 wherein a sensor is associated with said counter.

7. The system of claim 1 wherein said rivet setting mechanism is located in a housing having an aperture permitting the introduction of liquid therethrough.

8. The system of claim 1 wherein said control means has ON/OFF switch associated therewith.

* * * * *